US007665104B2

(12) United States Patent
Maehara et al.

(10) Patent No.: US 7,665,104 B2
(45) Date of Patent: Feb. 16, 2010

(54) CONTENT TRANSMISSION SYSTEM

(75) Inventors: Atsushi Maehara, Osaka (JP); Akiteru Deguchi, Yamatokoriyama (JP); Hitoshi Azuma, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 606 days.

(21) Appl. No.: 11/329,174

(22) Filed: Jan. 11, 2006

(65) Prior Publication Data

US 2006/0171343 A1 Aug. 3, 2006

(30) Foreign Application Priority Data

Jan. 28, 2005 (JP) ..... 2005-021595

(51) Int. Cl.
*G08C 17/00* (2006.01)

(52) U.S. Cl. ..... 725/10; 340/539

(58) Field of Classification Search ..... 340/539; 725/10

See application file for complete search history.

(56) References Cited

U.S. PATENT DOCUMENTS 7,187,277 B2 * 3/2007 Kobayashi ..... 340/539.1
2004/0051813 A1 3/2004 Marmaropoulos
2005/0128093 A1 * 6/2005 Genova et al. ..... 340/577
2008/0284590 A1 * 11/2008 Kates ..... 340/539.22

FOREIGN PATENT DOCUMENTS

JP 5-71985 10/1993
JP 11-252506 9/1999

* cited by examiner

*Primary Examiner*—Joseph P Hirl
*Assistant Examiner*—Fred Peng
(74) *Attorney, Agent, or Firm*—Nixon & Vanderhye P.C.

(57) ABSTRACT

In a conventional content transmission system, there has been a problem that it takes a long time from when a user, who tries to start viewing and listening of content, issues a command to a receiver by using a remote controller or the like until when the user can actually view and listen to the content from content viewing and listening equipment (content starting time). To this end, a content transmission system according to the present invention has a transmitter and a receiver including a human sensor and has a configuration that the state of the receiver is changed corresponding to a detection result of the human sensor so as to reduce the content starting time and power consumption.

14 Claims, 11 Drawing Sheets

CONTENT TRANSMISSION SYSTEM

This nonprovisional application claims priority under 35 U.S.C. § 119(a) on Patent Application No. 2005-021595 filed in Japan on Jan. 28, 2005, the entire contents of which are hereby incorporated by reference.

BACKGROUND

1. Field

The present disclosure's technical field relates to a content transmission system in which contents are transmitted from a transmitter to a receiver.

2. Description of the Prior Art

A conventional content transmission system has a transmitter and a receiver. The transmitter is connected with content equipment such as a DVD player, and the receiver is connected with content viewing and listening equipment such as a TV. Contents outputted from the content equipment are transmitted from the transmitter to the receiver, and are outputted from the receiver to the content viewing and listening equipment. Thereby, a user is capable of viewing and listening to the contents from the content viewing and listening equipment. Note that content recording equipment such as an HDD player may be connected with the receiver instead of the content viewing and listening equipment.

In the conventional content transmission system, when content transmission is initiated between the transmitter and the receiver, information required for the content transmission is first exchanged between the transmitter and the receiver, and then actual content transmission is performed. When a user operates the content equipment, the user generally transmits commands to the receiver by using a remote controller or the like whereby information including the commands are exchanged between the transmitter and the receiver, and the commands are transmitted to the content equipment, and the commands are reflected in the operation of the content equipment.

In the conventional content transmission system, it takes some time from when a user who tries to start viewing and listening of content issues a command to the receiver by using a remote controller or the like until when the user is actually capable of viewing and listening to the content from the content viewing and listening equipment (hereinafter referred to as content starting time). The main reason is that time for exchanging and sharing information required for content transmission between the transmitter and the receiver is long.

Taking some time from when a user desires to view and listen to content and operates an operation device such as a remote controller until when the user can actually view and listen to it causes the user to be stressed, so it is desired to reduce the content starting time.

Further, in a content transmission system, it is desired to reduce power consumption. In particular, in a content wireless transmission system, there are many cases where a receiver is of a portable type so as to utilize advantages of wireless, and is connected with content viewing and listening equipment of a portable type. In such a case, the receiver is driven by a battery and the like, so it is strongly desired to reduce power consumption of the receiver so as to increase the continuous driving time.

Japanese Patent Application Laid-open No. H11-252506 describes a camera surveillance system capable of reducing the starting time. The camera surveillance system described in Japanese Patent Application Laid-open No. H11-252506 is a system in which images recorded by and stored in a surveillance camera are reproduced and checked. In order to solve a problem that a certain time is required from when a sensor provided in the surveillance camera detects a human body until when recording starts actually and that recording is impossible during the time, the system is so configured that images are recorded temporarily on an auxiliary storage unit provided in the surveillance camera and are sequentially transferred to and recorded on a main storage unit later. However, the camera surveillance system described in JP-A 11-252506 (1999) can reduce time required before recording starts, but it cannot reduce time required before content is transmitted to the user viewing side, that is, to the main storage unit.

SUMMARY

A non-limiting embodiment of a content transmission system has a transmitter and a receiver including a human sensor, and is so configured as to include a content starting time change unit for changing a content starting time corresponding to a detection result of the human sensor.

With this configuration, it is determined whether reduction of content starting time is required corresponding to a detection result of the human sensor, and if reduction of content starting time is required, the content starting time is reduced, and if reduction of content starting time is not required, the content starting time is increased so as to reduce the power consumption. Therefore, it is possible to reduce content starting time and power consumption.

Note that a change of content starting time can be realized by changing the state of the receiver, for example.

Further, states of the receiver may include at least a first state in which content transmission can start immediately, a second state in which resources required for content transmission are released, and a third state in which power consumption is smaller when compared with the first state and the second state.

With this configuration, it is possible to flexibly change the state of the receiver corresponding to a detection result of the human sensor, so effective utilization of resources and realization of low power consumption are possible. In the second state, limited resources of the wireless band are released greater than in the case of the first state, whereby it is possible to utilize the limited resources effectively. Further, in the third state, it is possible to suppress power consumption more than the case of the first state or the second state. However, time required to become a state where content can be transmitted is shorter in the second state when compared with the third state, and is shorter in the first state when compared with the second state.

Further, the receiver may be so configured that if the human sensor detects a human when the receiver is in the second state or the third state, the state of the receiver changes to the first state. With this configuration, when a user is present around the receiver, content starting time is always shortened.

Further, the receiver may be so configured that if the human sensor continuously detects a human for a first period when the receiver is in the second state or in the third state, the state of the receiver changes to the first state. With this configuration, if a user is present around the receiver only for a slight time that the user does not intend to view and listen to, or if it is detected erroneously that a user is present around the receiver for only a slight time due to a malfunction of the human sensor, it is possible to prevent the state of the receiver from transitioning from the second state or the third state to the first state so as to prevent wasteful resources and wasteful power consumption. Note that a first change unit can be provided for changing the first period. By providing the first change unit, a user can adjust operation of the receiver responding to a case where a human walks outward and back near a boundary of the sensor effective range of the human sensor, that is, operation of the receiver that the user does not intend, corresponding to the environment and moving patterns.

Further, the receiver may be so configured that if the human sensor does not detect a human any more when the receiver is in the first state, the state of the receiver changes to the second state or the third state, and if the human sensor does not detect a human any more when the receiver is in the second state, the state of the receiver changes to the third state. With this configuration, it is possible to flexibly change the state of the receiver immediately responding to the fact that the human sensor does not detect a human any more. Thereby, wasteful resources are released and wasteful power is reduced, so effective utilization of resources and lower power consumption can be achieved.

Further, the receiver may be so configured that if a state where the human sensor does not detect a human continues for a second period when the receiver is in the first state, the state of the receiver changes to the second state or the third state, and if a state where the human sensor does not detect a human continues for the second period when the receiver is in the second state, the state of the receiver changes to the third state. With this configuration, if a user is not present around the receiver for only a slight time, or if it is detected erroneously that a user is not present around the receiver for only a slight time due to a malfunction of the human sensor, it is possible to prevent operation not intended by the user, such as resources being released and content transmission being stopped. Note that a second change unit can be provided for changing the second period. By providing the second change unit, a user can adjust operation of the receiver responding to a case where a human walks outward and back near the boundary of the sensor effective range of the human sensor, that is, operation of the receiver that the user does not intend, corresponding to the environment and moving patterns.

Further, in the content transmission system having the configurations described above (hereinafter referred to as a first group of configurations), a stop unit can be provided which stops content transmission when the human sensor does not detect a human any more during the content transmission. With this configuration, it is possible to prevent wasteful content transmission and to prevent wasteful power consumption.

Further, in the content transmission system of the first group of configurations, a stop unit can be provided which stops content transmission if a state where the human sensor does not detect a human continues for a third period during the content transmission. With this configuration, if a user is not present around the receiver for only a slight time that the user does not intend to view and listen to, or if it is detected erroneously that a user is not present around the receiver for only a slight time due to a malfunction of the human sensor, it is possible to prevent the content transmission being stopped. Note that a third change unit can be provided for changing the third period. By providing the third change unit, a user can adjust operation of the receiver responding to a case where a human walks outward and back near the boundary of the sensor effective range of the human sensor, that is, operation of the receiver that the user does not intend, corresponding to the environment and moving patterns. Further, the second period and the third period can be the same length.

Further, in the content transmission system having each configuration described above, the receiver may include an input unit for inputting a control command relating to content transmission , and the state of the receiver may be changed if a state where the control command is not inputted to the input unit continues for a fourth period. With this configuration, it is possible to realize effective utilization of resources and low power consumption in a case that a user falls asleep for example. Note that a fourth change unit can be provided for changing the fourth period. By providing the fourth change unit, it is possible to adjust an operation corresponding to the behavior pattern of the user so as to prevent an operation not intended by the user such as stopping of content transmission when the user continues viewing and listening.

Further, states of the receiver may include at least a first state in which content transmission can start immediately, a second state in which resources required for content transmission are released, and a third state in which power consumption is smaller comparing with the first state and the second state, and if a state where the control command is not inputted into the input unit continues for the fourth period when the receiver is in the first state, the state of the receiver may change to the second state or the third state, and if a state where the control command is not inputted into the input unit continues for the fourth period when the receiver is in the second state, the state of the receiver may change to the third state. With this configuration, if a user falls asleep for example, wasteful resources are released and wasteful power is reduced, whereby it is possible to realize effective utilization of resources and low power consumption.

Note that in the content transmission system having each configuration described above, a fourth change unit may be provided for changing the sensor effective range of the human sensor. Thereby, it is possible to prevent a stop of content transmission that a user is unexpected or securing of wasteful resources.

Further, in the content transmission system having each configuration described above, a switch unit may be provided for making the human sensor to be effective or ineffective. With this configuration, it is possible to reflect user intension when the user gives preference to reduction of power consumption over reduction of content starting time.

DESCRIPTION OF THE PREFERRED EMBODIMENTS

Here, a content wireless transmission system will be described with one or more non-limiting illustrative embodiments. For example, the content wireless transmission system is used in a case where a user views and listens td content from content viewing and listening equipment in a different room located separating from a room where content equipment holding and providing the content such as video and audio exists.

Figure 1:
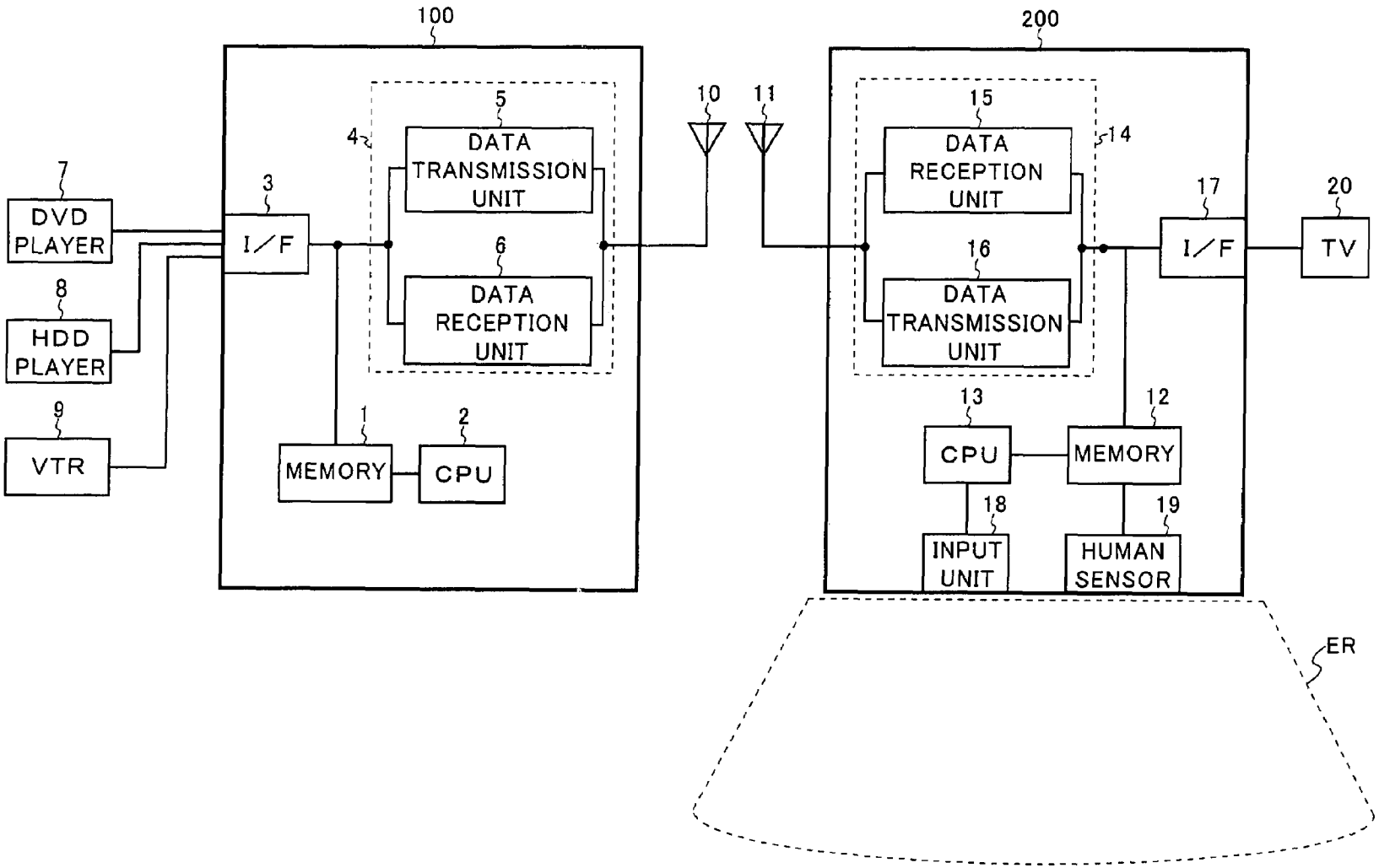
FIG. 1 is a diagram showing an exemplary configuration of a content wireless transmission system according to a non-limiting embodiment of the present invention.

FIG. 1 shows an exemplary configuration of the content wireless transmission system according to a non-limiting illustrative embodiment. The content wireless transmission system shown in FIG. 1 has a transmitter 100 and a receiver 200. A DVD player 7, an HDD player 8 and a VTR 9, which are content equipment, and an antenna 10 are connected with the transmitter 100. An antenna 11 and a TV 20, which is content viewing and listening equipment, are connected with the receiver 200.

The transmitter 100 includes a memory 1, a CPU 2 for controlling the overall operation of the transmitter by using data stored on the memory 1, an interface 3, and a wireless unit 4, which includes a data transmission unit 5 and a data reception unit 6.

The receiver 200 includes a memory 12, a CPU 13 for controlling the overall operation of the receiver by using data stored on the memory 12, a wireless unit 14 (which includes a data reception unit 15 and a data transmission unit 16), an interface 17, an input unit 18 which receives remote control signals transmitted from a remote controller whereby control commands relating to user settings and content transmission and the like are inputted, and a human sensor 19.

The human sensor 19 detects whether a human is present or not within a sensor effective range ER with an infrared ray. With user settings, the human sensor 19 is capable of setting whether to detect humans within the sensor effective range ER, changing the sensor effective range ER by changing the sensitivity, and giving directional property to the sensor effective range ER. User settings are transmitted from a remote controller to the input unit 18, and corresponding to the user settings inputted by the input unit 18, the CPU 13 changes the settings of the human sensor 19.

The CPU 13 changes the state of the receiver 200 corresponding to a detection result of the human sensor 19. States of the receiver 200 include a standby state where content can be received immediately from the transmitter 100 by securing the band, an awake state where it is linked with the transmitter 100, and a sleep state where the power of the wireless unit 14 is turned off. When content data is transmitted from the transmitter 100 in the standby state, the receiver 200 receives the content data at the data reception unit 15 of the wireless unit 14, and while accumulating the content data on the memory 12, transmits the content data to the TV 20 via the interface 17. Thereby, the user can view and listen to the content from the TV 20.

Figure 2:
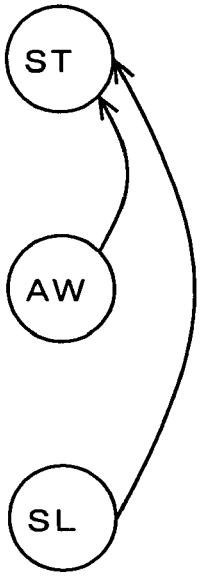
FIG. 2 is a diagram showing a non-limiting example state transition when a human sensor detects a human.
Figure 3:
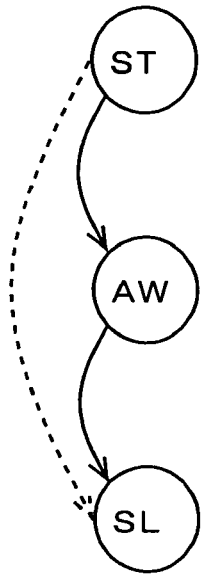
FIG. 3 is a diagram showing a non-limiting example state transition when the human sensor does not detect a human any more.
Figure 4:
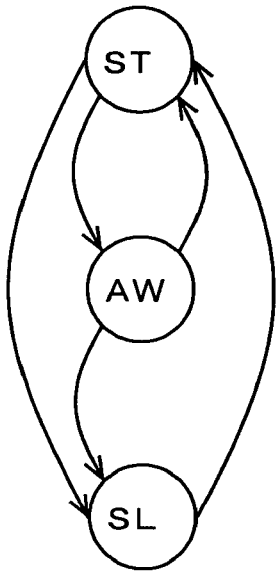
FIG. 4 is a diagram showing a non-limiting example state transition corresponding to presence or absence of a command input.

As for state transition of the receiver 200, description will be given with reference to FIG. 2 to FIG. 4. FIG. 2 is a diagram showing a state transition of the receiver 200 when the human sensor 19 detects a human or when a state of detecting a human continues for a certain time. In this case, if the state of the receiver 200 is in a sleep state SL or in an awake state AW, it immediately transits to a standby state ST and waits in a state capable of receiving content. With such a state transition, it is possible to reduce the content starting time. FIG. 3 is a diagram showing a state transition of the receiver 200 when the human sensor 19 does not detect a human any more or when a state of not detecting a human continues for a certain time. In this case, if the state of the receiver 200 is in a standby state ST, it immediately transits to an awake state AW, and if it is in an awake state AW, it immediately transits to a sleep state SL. With user settings, if the receiver 200 is in a standby state ST, it may immediately transit not to an awake state AW but to a sleep state SL. With such a state transition, it is possible to reduce power consumption. FIG. 4 is a diagram showing a state transition of the receiver 200 corresponding to presence or absence of control command input relating to content transmission. When a control command relating to content transmission is inputted, if the state of the receiver 200 is in a sleep state SL or in an awake state AW, the receiver 200 immediately transits to a standby state ST. If a period, during which no control command relating to content transmission is inputted, continues for a certain period, when the state of the receiver 200 is in a standby state ST, it immediately transits to an awake state AW, and when it is in an awake state AW, it immediately transits to a sleep state. Note that with user settings, if the state of the receiver 200 is in a standby state ST, it may immediately transit not to an awake state AW but to a sleep state SL. With such a state transition, in order to save content transmitted from the transmitter 100 in content recording equipment such as an HDD player connected with the receiver 200 by programmed recording for example, it is possible to cause the state of the receiver 200 to be in a standby state even though the human sensor 19 does not detect a human. Further, if a user sleeps for a long time while viewing and listening to content, a period in which no control command relating to content transmission is received continues for a certain time, so it is possible to stop the content transmission and changes the state of the receiver 200 to an awake state and to a sleep state sequentially or to a sleep state directly to thereby save the resources and the power consumption.

Figure 5:
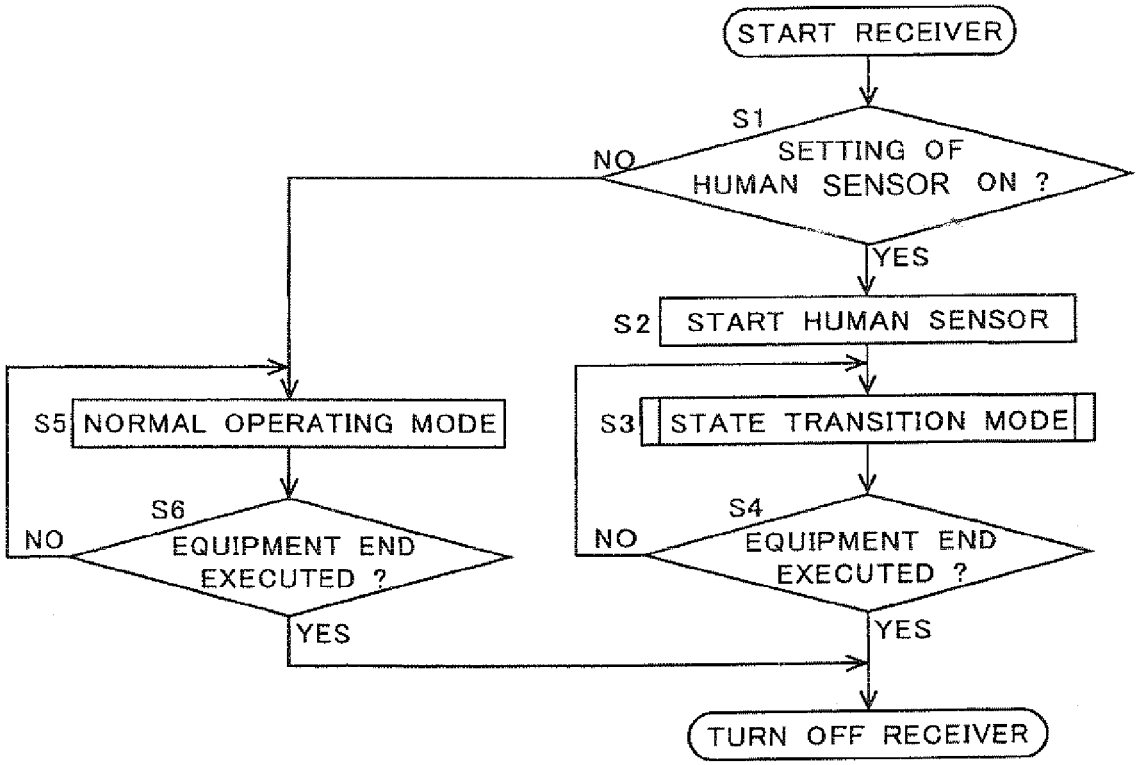
FIG. 5 is a flowchart showing a non-limiting example overall operation of a receiver.

Next, the overall operation of the receiver 200 will be described with reference to the flowchart of FIG. 5. When the input unit 18 inputs an equipment starting command, the receiver 200 is started and the flow of FIG. 5 starts. When the receiver 200 is started, first the CPU 13 determines whether the setting of the human sensor 19 is ON (step S1). If the setting of the human sensor 19 is ON (YES in step S1), the human sensor 19 is started by a control of the CPU 13 (step S2), and the processing moves to step S3. On the other hand, if the setting of the human sensor 19 is OFF (NO in step S1), the CPU 13 causes the operating mode of the receiver 200 to the normal operating mode (step S5), and then the processing moves to step S6. In a non-limiting aspect, the normal operating mode can mean an operating mode in which the state of the receiver 200 is normally in a sleep state, and when the input unit 18 inputs a control command, the power of the wireless unit 14 is turned ON, and information required for content transmission is exchanged between the transmitter 100 and the receiver 200, and then content data is received.

In step S3, the CPU 13 makes the operating mode of the receiver 200 to a state transition mode in which the state of the receiver 200 is changed corresponding to the detection result of the human sensor 19 (step S3), and then the processing moves to step S4. Note that the details of the state transition mode will be described later.

In step S4, the CPU 13 determines whether the CPU 13 has executed an equipment end command corresponding to the equipment end command inputted by the input unit 18. If the equipment end command has not been executed (NO in step S4), the processing moves to step S3, and if the equipment end command has been executed (YES in step S4), the power of the receiver 200 is turned OFF and the flow ends.

In step S6, the CPU 13 determines whether the CPU 13 has executed an equipment end command corresponding to the equipment end command inputted by the input unit 18. If the equipment end command has not been executed (NO in step S6), the processing moves to step S5, and if the equipment end command has been executed (YES in step S6), the power of the receiver 200 is turned OFF and the flow ends. Note that if the setting of the human sensor 19 is changed during the flow operation of FIG. 5, the human sensor 19 is changed to an OFF state by the control of the CPU 13, and the processing moves to step S1.

Next, the details of the state transition mode (step S3 in FIG. 5) will be described with reference to the flowchart of FIG. 6. When the state transition mode starts, detection of human, that is, sensing, is first performed by the human sensor 19 (step S11). Next, the CPU 13 determines whether a human is detected through sensing based on the output of the human sensor 19 (step S12).

If a human is detected (YES in step S12), state transition 1 is performed (step S13), and then the processing moves to step S15. In contrast, if a human is not detected (NO in step S12), state transition 2 is performed (step S14), and then the processing moves to step S15. Note that the details of the state transition 1 and the state transition 2 will be described later.

In step S15, the CPU 13 determines whether the state of the receiver 200 is in a standby state or not. If the state of the receiver 200 is in a standby state (YES in step S15), the input unit 18 waits for a control command relating to content transmission for a certain time (step S116), and then the CPU 13 determines whether the input unit 18 has inputted a control command (step S17). If the state of the receiver 200 is not in a standby state (NO in step S115), the state transition mode ends.

As a result of the determination in step S17, if the input unit 18 has inputted a control command (YES in step S17), the CPU 13 executes the control command (step S18), and then the state transition mode ends. In contrast, as a result of the determination in step S17, if the input unit 18 has not inputted the control command (NO in step S17), the state transition mode ends straightly.

Figure 6:
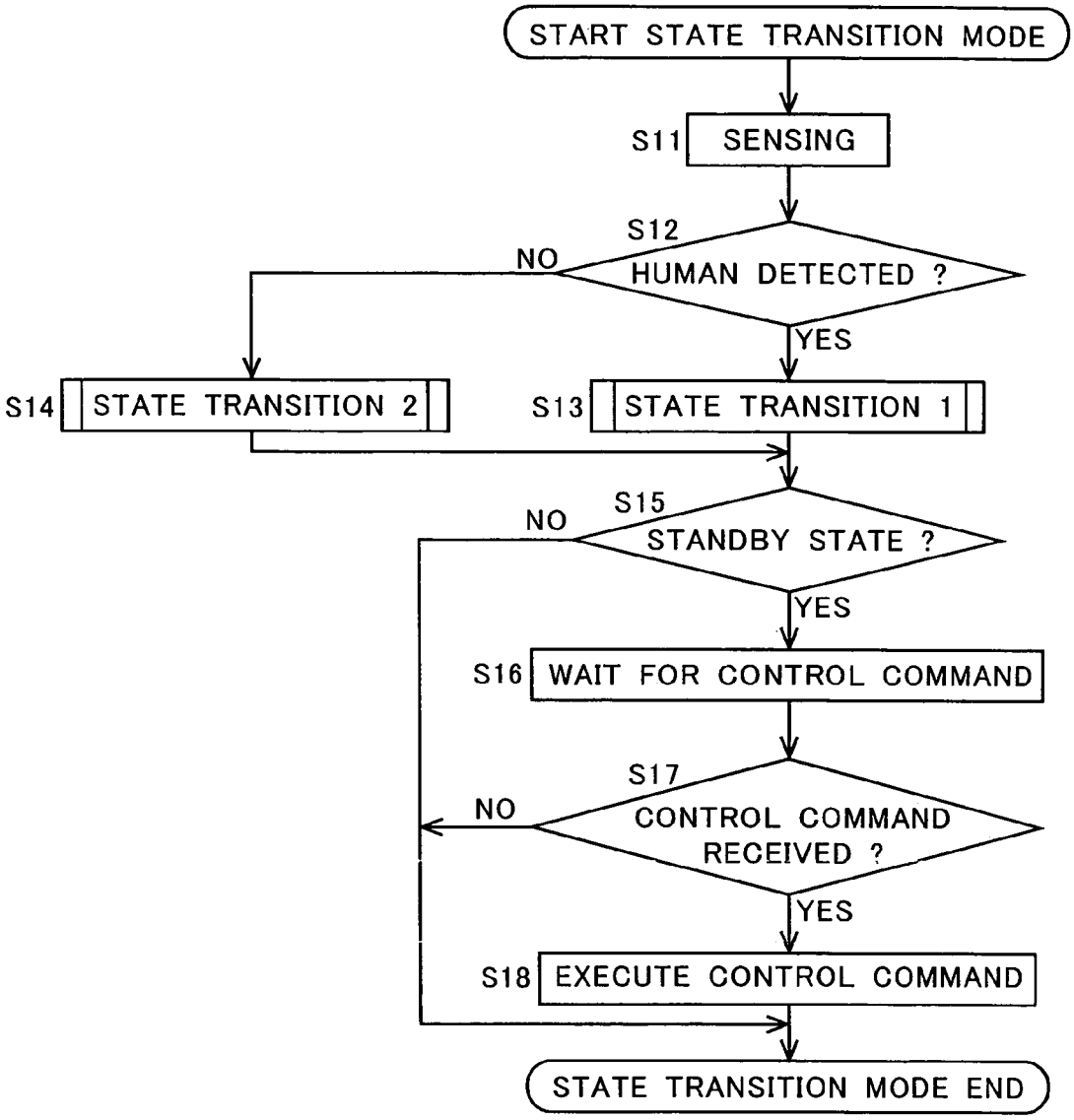
FIG. 6 is a flowchart showing a non-limiting example operation of the receiver in a state transition mode.

In the flow operation shown in FIG. 6 described above, a useless state transition may be caused in a case where a human is present in the sensor effective range ER of the human sensor 19 for only a short time that the user does not intend to view and listen to the content, or it is erroneously detected that a human is present in the sensor effective range ER of the human sensor 19 for only a short time due to a malfunction of the human sensor 19, or the like. From the viewpoint of preventing such a useless state transition, the flow operation shown in FIG. 7 may be performed in the state transition mode (step S3 in FIG. 5).

Figure 7:
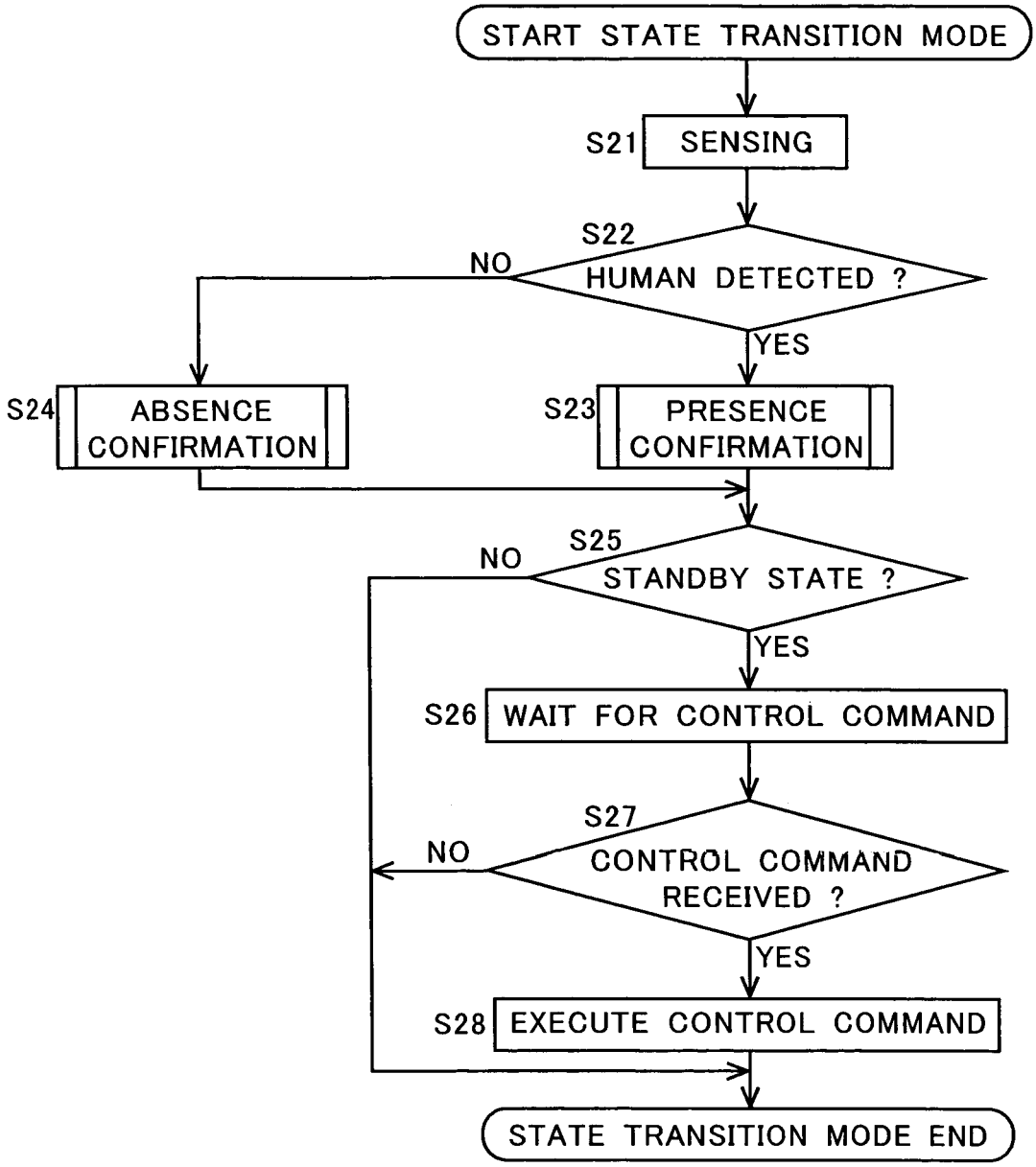
FIG. 7 is a flowchart showing another non-limiting example operation of the receiver in the state transition mode.

In the flow operation shown in FIG. 7, when the state transition mode starts, detection of humans, that is, sensing, by the human sensor 19 is performed (step S21). Then, the CPU 13 determines whether a human is detected by the sensing based on the output of the human sensor 19 (step S22).

If a human is detected (YES in step S22), confirmation of whether a state of detecting the human by the human sensor 19 continues for a certain time, that is, presence confirmation, is performed (step S23), and then the processing moves to step S25. In contrast, if a human is not detected (NO in step S22), confirmation of whether a state of not detecting a human by the human sensor 19 continues for a certain time, that is, absence confirmation, is performed (step S24), and then the processing moves to step S25. Note that the details of the presence confirmation and the absence confirmation will be described later.

In step S25, the CPU 13 determines whether the receiver 200 is in a standby state. If the receiver 200 is in a standby state (YES in step S25), the input unit 18 waits for a control command relating to content transmission for a certain time (step S26), and then the CPU 13 determines whether the input unit 18 has inputted a control command (step S27). If the receiver 200 is not in a standby state (NO in step S25), the state transition mode ends.

As a result of determination in step S27, if the input unit 18 has inputted a control command (YES in step S27), the CPU 13 executes the control command (step S28), and then the state transition mode ends. In contrast, as a result of determination in step S27, if the input unit 18 has not inputted a control command (NO in step S27), the state transition mode ends straightly.

Figure 8:
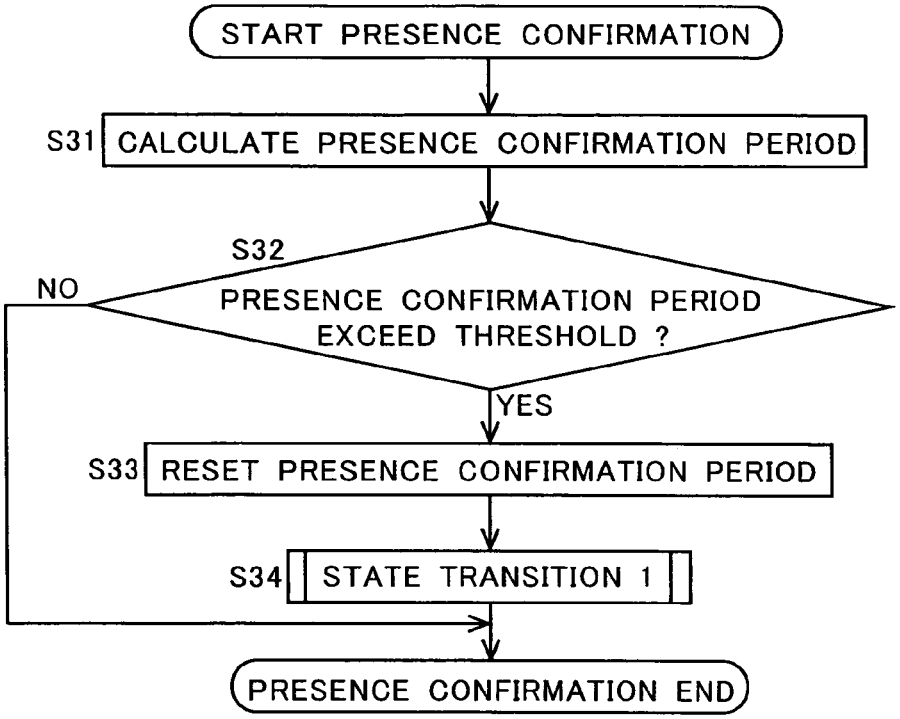
FIG. 8 is a flowchart showing a non-limiting example operation of the receiver in processing of presence confirmation.

Next, the details of the presence confirmation (step S23 in FIG. 7) will be described with reference to the flowchart of FIG. 8. In the flow operation shown in FIG. 8, the CPU 13 calculates a presence confirmation period of the current time by adding a period, obtained by subtracting the time of the previous presence confirmation from the current time, to the presence confirmation period calculated at the time of previous presence confirmation, and stores the value on the memory 12 (step S31), then the processing moves to step S32. Therefore, in the aspect of performing the presence confirmation (step S23 in FIG. 7), the CPU 13 has a timer function.

In step S32, the CPU 13 determines whether the value of the presence confirmation period stored on the memory 12 exceeds a threshold for presence confirmation period stored on the memory 12. Note that the threshold for presence confirmation period stored on the memory 12 can be changed by inputting user settings by the input unit 18.

If the presence confirmation period exceeds the threshold (YES in step S32), the CPU 13 resets the value of the presence confirmation period stored on the memory 12 (step S33), and then the state transition 1 is executed (step S34), and the presence confirmation ends. In contrast, if the presence confirmation period does not exceed the threshold (NO in step S32), the presence confirmation ends straightly. Note that the details of the state transition 1 will be described later.

Figure 9:
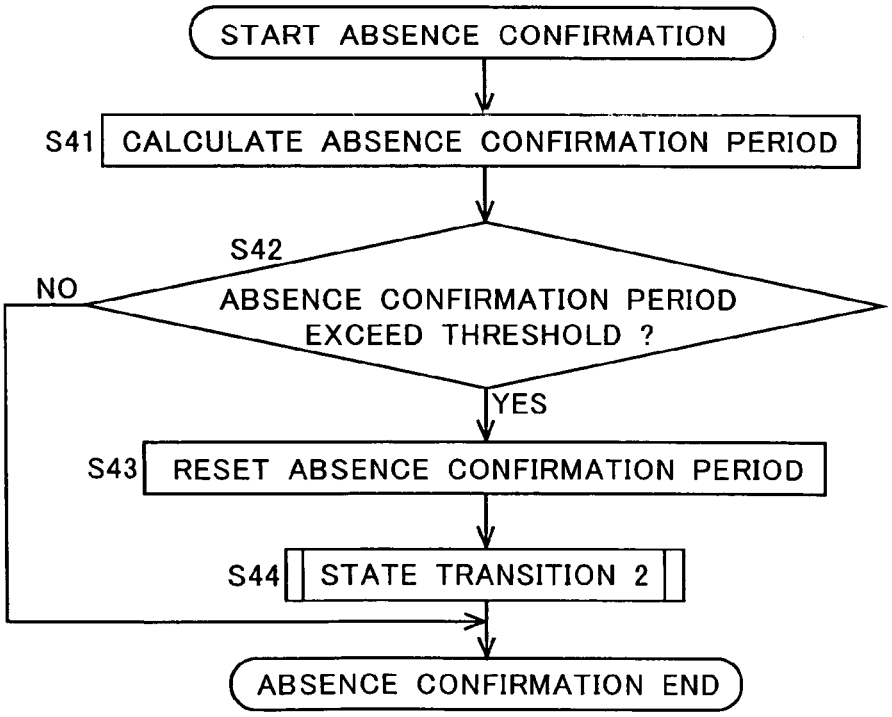
FIG. 9 is a flowchart showing a non-limiting example operation of the receiver in processing of absence confirmation.

Next, the details of the absence confirmation (step S24 in FIG. 7) will be described with reference to the flowchart of FIG. 9. In the flow operation shown in FIG. 9, the CPU 13 calculates an absence confirmation period of the current time by adding a period, obtained by subtracting the time of the previous absence confirmation from the current time, to the absence confirmation period calculated at the time of previous absence confirmation, and stores the value on the memory 12 (step S41), then the processing moves to step S42. Therefore, in the aspect of performing the absence confirmation (step S24 in FIG. 7), the CPU 13 has a timer function.

In step S42, the CPU 13 determines whether the value of the absence confirmation period stored on the memory 12 exceeds a threshold for absence confirmation period stored on the memory 12. Note that the threshold for absence confirmation period stored on the memory 12 can be changed by inputting user settings by the input unit 18.

If the absence confirmation period exceeds the threshold (YES in step S42), the CPU 13 resets the value of the absence confirmation period stored on the memory 12 (step S43), and then the state transition 2 is executed (step S44), and the absence confirmation ends. In contrast, if the absence confirmation period does not exceed the threshold (NO in step S42), the absence confirmation ends straightly. Note that the details of the state transition 2 will be described later.

Next, the details of the state transition 1 (step S13 in FIG. 6 and step S34 in FIG. 8) will be described with reference to the flowchart of FIG. 10. In the flow operation of FIG. 10, the CPU 13 determines whether the receiver 200 is in a sleep state (step S51).

If the receiver 200 is in a sleep state (YES in step S51), the CPU 13 transfers the state of the receiver 200 from a sleep state to a standby state (step S52), whereby the state transition 1 ends. In contrast, if the receiver 200 is not in a sleep state (NO in step S51), the CPU 13 determines whether the receiver 200 is in an awake state (step S53).

If the receiver 200 is in an awake state (YES in step S53), the CPU 13 transfers the state of the receiver 200 from an awake state to a standby state (step S52), and then the state transition 1 ends. On the other hand, if the state of the receiver 200 is not in an awake state (NO in step S53), the state transition 1 ends straightly. By causing the state transition 1 to be in the flow operation shown in FIG. 10, the flow operation shown in FIG. 6 or FIG. 7 realizes the state transition shown in FIG. 2.

Next, the details of the state transition 2 (step S14 in FIG. 6 and step S44 in FIG. 9) will be described with reference to the flowchart of FIG. 11. In the flow operation shown in FIG. 11, the CPU 13 determines whether the receiver 200 is in a standby state (step S61). In step S61, a state where content is actually transmitted is also included in the standby state.

If the receiver 200 is in a standby state (YES in step S61), the CPU 13 causes the state of the receiver 200 to transit from the standby state to an awake state (step S62), and the state transition 2 ends. In step S62, if transition from a state where content is actually transmitted to an awake state is performed, the transmission of the content is stopped. In contrast, if the receiver 200 is not in a standby state (NO in step S61), the CPU 13 determines whether the receiver 200 is in an awake state (step S63).

If the receiver 200 is in an awake state (YES in step S63), the CPU 13 causes the state of the receiver 200 to transit from the awake state to a sleep state (step S64), and the state transition 2 ends. In contrast, if the receiver 200 is not in an awake state (NO in step S63), the state transition 2 ends straightly. By causing the state transition 2 to be in the flow operation shown in FIG. 11, the flow operation shown in FIG. 6 or FIG. 7 realizes the state transition shown by the arrows of solid lines in FIG. 3. In order to realize the state transition shown by the arrow of dotted line in FIG. 3, step S62 in the flow shown in FIG. 11 may be changed to a step in which the CPU 13 causes the state of the receiver 200 from the standby state to a sleep state.

In the description given above, the state of the receiver 200 is changed corresponding solely to a detection of a human by the human sensor 19. However, in order to save content transmitted from the transmitter 100 by programmed recording in content recording equipment such as an HDD player connected with the receiver 200, it is required to cause the receiver 200 to be in a standby state even when the human sensor 19 does not detect a human. Further, if a user falls asleep for a long time during viewing and listening of content, the content is not viewed and listened although the human sensor 19 detects a human, so the resources and power consumption can be saved if the content transmission is stopped and the state of the receiver 200 is changed to an awake state and to a sleep state sequentially or changed to a sleep state directly. From this point of view, in the state transition mode (step S3 in FIG. 5), the flow operation shown in FIG. 12 may be executed.

Figure 12:
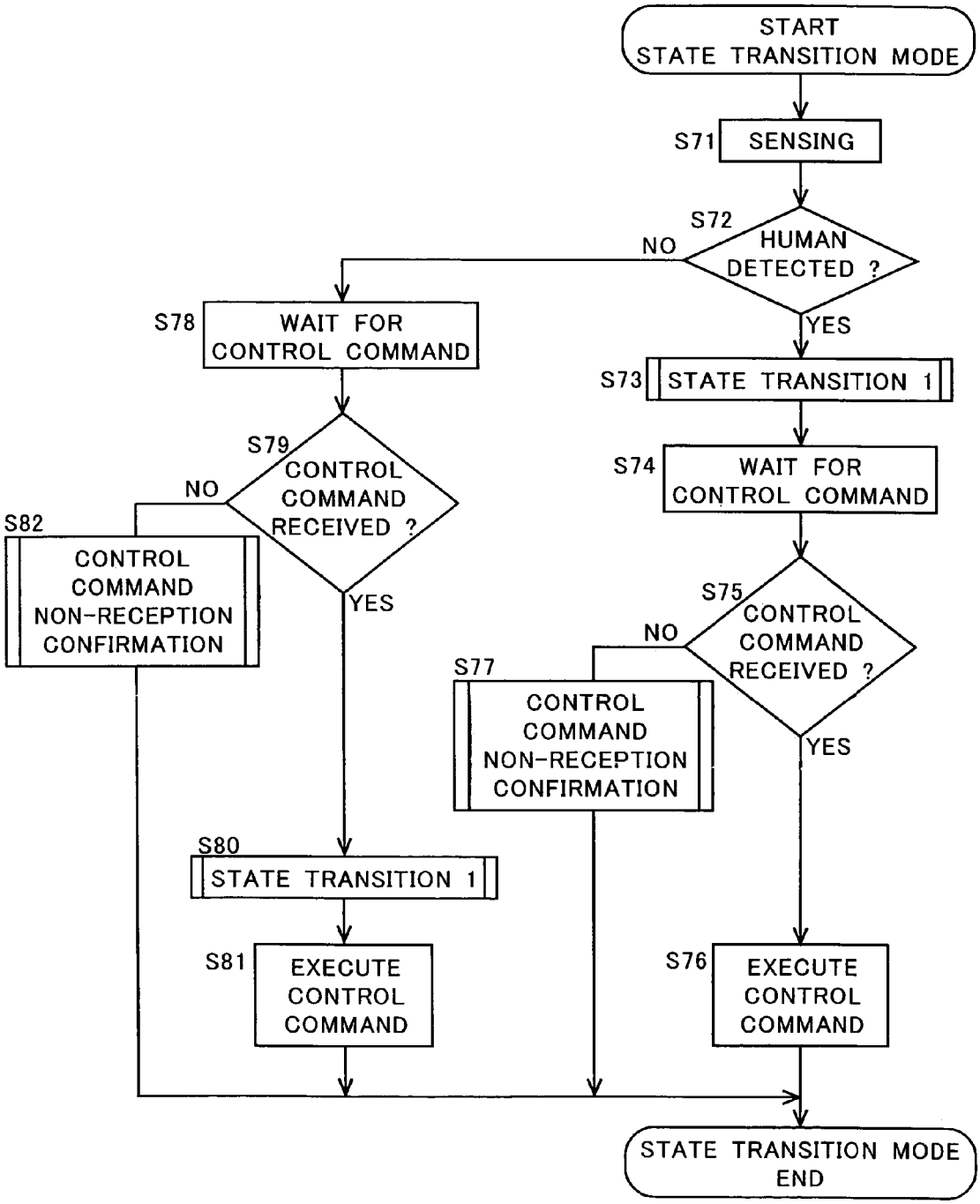
FIG. 12 is a flowchart showing still another non-limiting example operation of the receiver in the state transition mode.

In the flow operation in FIG. 12, when the state transition mode starts, a detection of human, that is, sensing, by the human sensor 19 is performed first (step S71). Next, the CPU 13 determines whether a human is detected by the sensing based on the output of the human sensor 19 (step S72).

Figure 10:
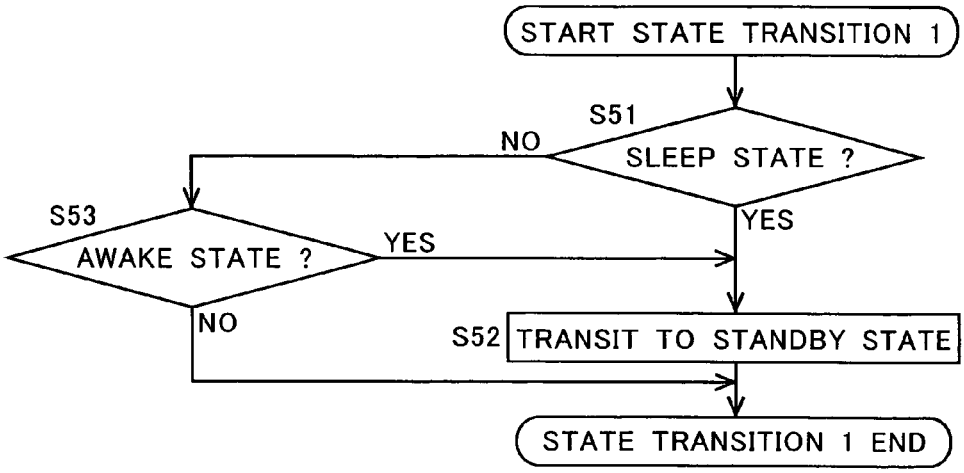
FIG. 10 is a flowchart showing a non-limiting example operation of the receiver in processing of state transition 1.

If a human is detected (YES in step S72), the state transition 1, that is, the flow operation shown in FIG. 10, is performed (step S73), the input unit 18 waits for a control command relating to content transmission for a predetermined period (step S74), and then the CPU 13 determines whether the input unit 18 has inputted a control command (step S75). If the input unit 18 has inputted a control command (YES in step S75), the CPU 13 executes the control command (step S76), and then the state transition mode ends. In contrast, if the input unit 18 has not inputted a control command (NO in step S75), control command non-reception confirmation is performed (step S77), and then the state transition mode ends. Note that the details of the control command non-reception confirmation will be described later.

As a result of the determination in step S72, if a human is not detected (NO in step S72), the input unit 18 waits for a control command relating to content transmission for a predetermined period (step S78), and then the CPU 13 determines whether the input unit 18 has been inputted a control command (step S79). If the input unit 18 has inputted a control command (YES in step S79), the state transition 1, that is, the flow operation shown in FIG. 10, is performed (step S80), and the CPU 13 executes the control command (step S81), and then the state transition mode ends. In contrast, if the input unit 18 has not inputted a control command (NO in step S79), a control command non-reception confirmation is performed (step S82), and then the state transition mode ends. Note that the details of the control command non-reception confirmation will be described later.

Figure 13:
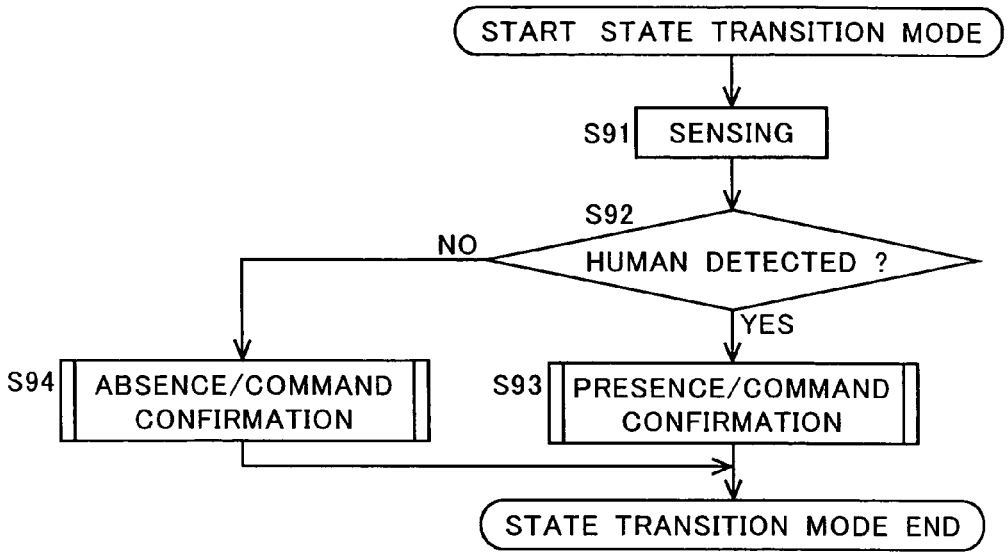
FIG. 13 is a flowchart showing yet another non-limiting example operation of the receiver in the state transition mode.

From the viewpoint considered when adopting the flow operation of FIG. 7 and the viewpoint considered when adopting the flow operation of FIG. 12, in the state transition mode (step S3 in FIG. 5), the flow operation shown in FIG. 13 may be performed.

In the flow operation shown in FIG. 13, when the state transition mode starts, detection of a human, that is, sensing, by the human sensor 19 is performed first (step S91). Next, the CPU 13 determines whether a human is detected by the sensing based on the output of the human sensor 19 (step S92).

If a human is detected (YES in step S92), presence/command confirmation is performed (step S93), and then the state transition mode ends. In contrast, if a human is not detected (NO in step S92), absence/command confirmation is performed (step S94), and then the state transition mode ends. Note that the details of presence/command confirmation and absence/command confirmation will be described later.

Figure 14:
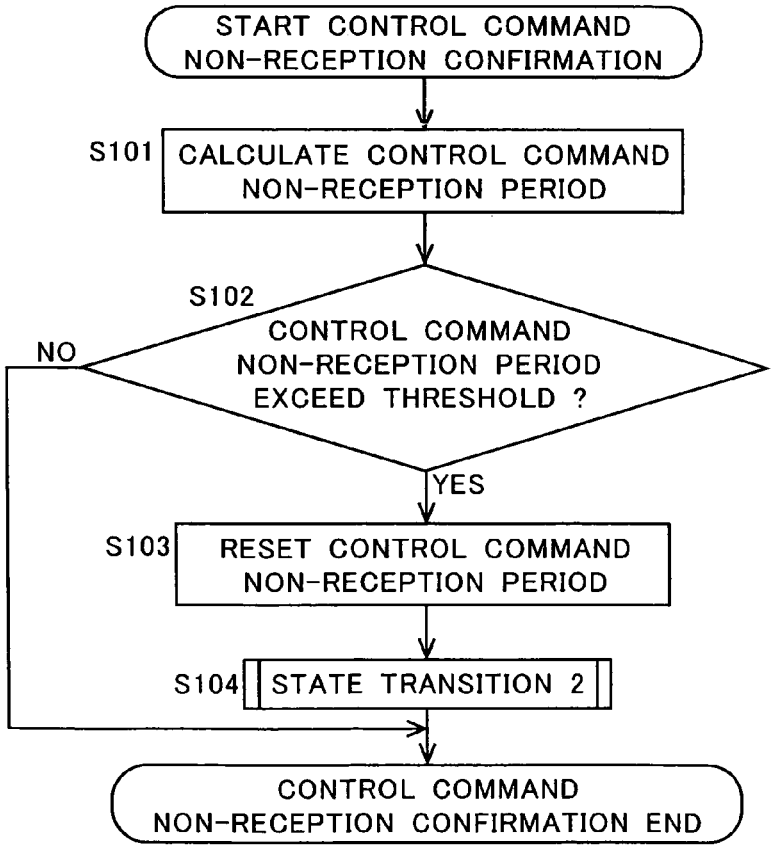
FIG. 14 is a flowchart showing a non-limiting example operation of the receiver in processing of control command non-reception confirmation.

Next, the details of the control command non-reception confirmation (step S77 and S82 in FIG. 12) will be described with reference to the flowchart of FIG. 14. In the flow operation shown in FIG. 14, the CPU 13 calculates a control command non-reception confirmation period of the current time by adding a period, obtained by subtracting the time of the previous control command non-reception confirmation from the current time, to the control command non-reception confirmation period calculated at the time of previous control command non-reception confirmation, and stores the value on the memory 12 (step S101), and then the processing moves to step S102. Therefore, in the aspect of performing the control command non-reception confirmation (step S77 and S82 in FIG. 12), the CPU 13 has a timer function.

In step S102, the CPU 13 determines whether the value of the control command non-reception confirmation period stored on the memory 12 exceeds a threshold for control command non-reception confirmation period stored on the memory 12. The threshold for control command non-reception confirmation period stored on the memory 12 may be changed by inputting user settings by the input unit 18.

Figure 11:
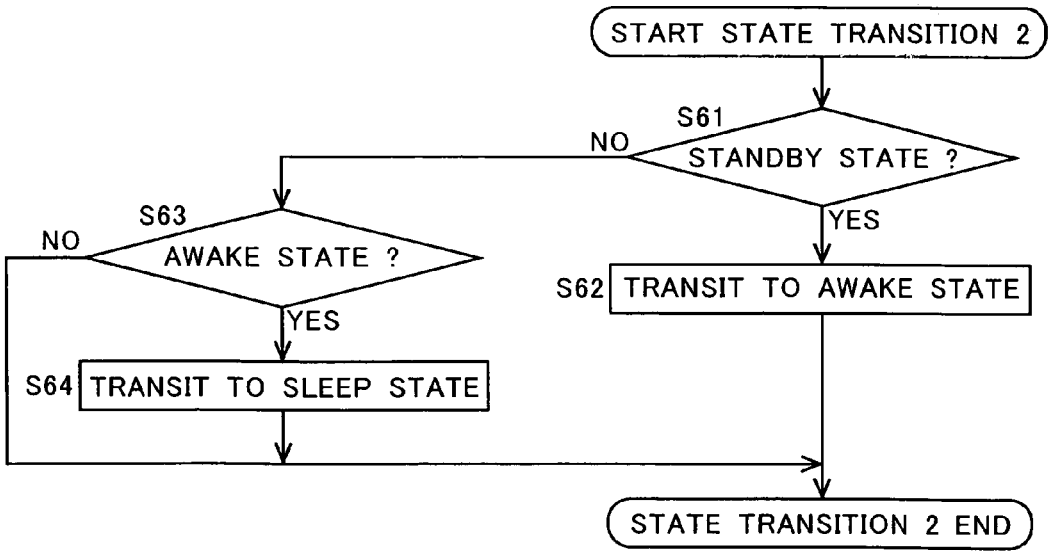
FIG. 11 is a flowchart showing a non-limiting example operation of the receiver in processing of state transition 2.

If the control command non-reception confirmation period exceeds the threshold (YES in step S1102), the CPU 13 resets the value of the control command non-reception confirmation period stored on the memory 12 (step S103), then the state transition 2, that is, the flow operation shown in FIG. 11, is performed (step S104), and the control command non-reception confirmation ends. In contrast, if the control command non-reception confirmation period does not exceed the threshold (NO in step S102), the control command non-reception confirmation ends straightly.

Figure 15:
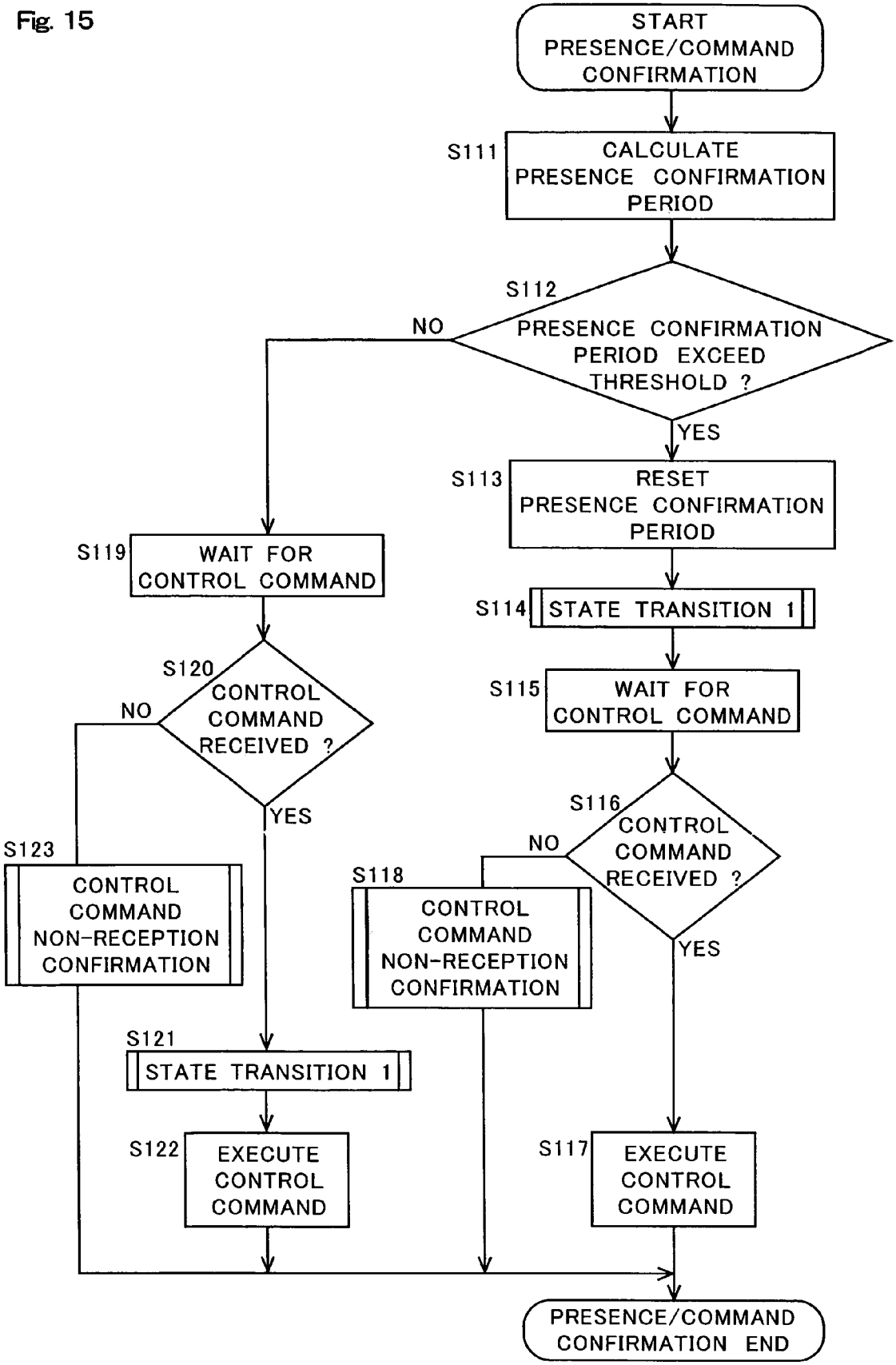
FIG. 15 is a flowchart showing a non-limiting example operation of the receiver in processing of presence/command confirmation.

Next, the details of the presence/command confirmation (step S93 in FIG. 13) will be described with reference to the flowchart of FIG. 15. In the flow operation shown in FIG. 15, the CPU 13 calculates the presence confirmation period of the current time by adding a period, obtained by subtracting the time of the previous presence/command confirmation from the current time, to the presence confirmation period calculated at the time of previous presence/command confirmation, and stores the value on the memory 12 (step S111), and then the processing moves to step S112. Therefore, in the aspect of executing the presence/command confirmation (step S93 in FIG. 13), the CPU 13 has a timer function.

In step S112, the CPU 13 determines whether the value of the presence confirmation period stored on the memory 12 exceeds a threshold for presence confirmation period stored on the memory 12. Note that the threshold for presence confirmation period stored on the memory 12 may be changed by inputting user settings by the input unit 18.

If the presence confirmation period exceeds the threshold (YES in step S112), the CPU 13 resets the value of the presence confirmation period stored on the memory 12 (step S113), and the state transition 1, that is, the flow operation shown in FIG. 10, is executed (step S114), and the input unit 18 waits for a control command relating to content transmission for the predetermined period (step S115), and then the CPU 13 determines whether the input unit 18 has inputted a control command (step S116). If the input unit 18 has inputted a control command (YES in step S116), the CPU 13 executes the control command (step S117), and then the presence/command confirmation ends. In contrast, if the input unit 18 has not inputted the control command (NO in step S116), the control command non-reception confirmation, that is, the flow operation shown in FIG. 14, is executed (step S118), and then the presence/command confirmation ends.

As a result of the determination in step S112, if the presence confirmation period does not exceed the threshold (NO in step S112), the input unit 18 waits for a control command relating to content transmission for a predetermined period (step S119), and then the CPU 13 determines whether the input unit 18 has inputted the control command (step S120). If the input unit 18 has inputted the control command (YES in step S120), the state transition 1, that is, the flow operation shown in FIG. 10, is executed (step S121), and the CPU 13 executes the control command (step S122), and then the presence/command confirmation ends. In contrast, if the input unit 18 has not inputted a control command (NO in step S120), the control command non-reception confirmation, that is, the flow operation shown in FIG. 14, is executed (step S123), and then the presence/command confirmation ends.

Figure 16:
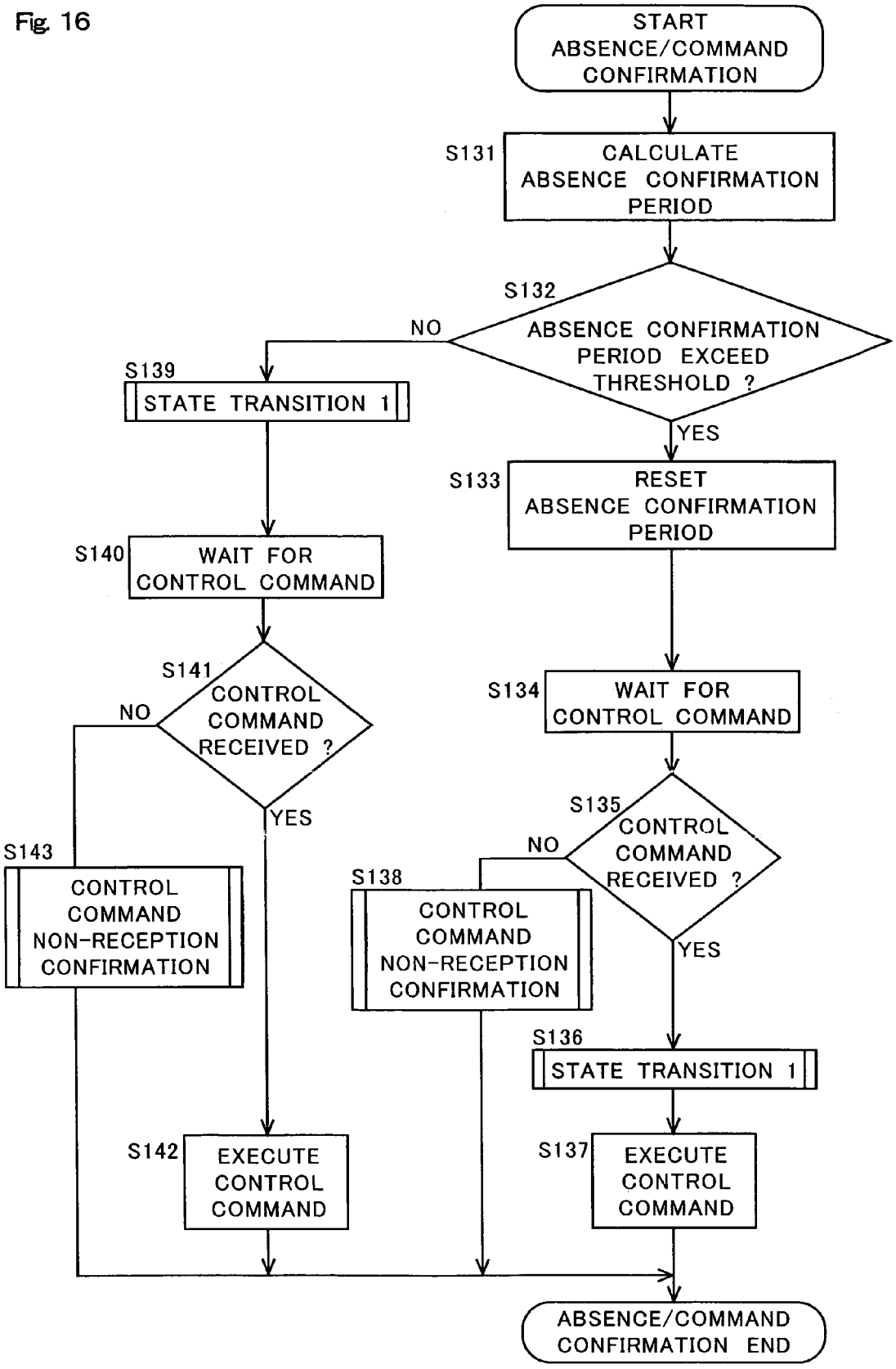
FIG. 16 is a flowchart showing a non-limiting example operation of the receiver in processing of absence/command confirmation.

Next, the details of the absence/command confirmation (step S94 in FIG. 13) will be described with reference to the flowchart of FIG. 16. In the flow operation shown in FIG. 16, the CPU 13 calculates the absence confirmation period at the current time by adding a period, obtained by subtracting the time of the previous absence/command confirmation from the current time, to the absence confirmation period calculated at the time of previous absence/command confirmation, and stores the value on the memory 12 (step S131), and then the processing moves to step S132. Therefore, in the aspect of executing the absence/command confirmation (step S94 in FIG. 13), the CPU 13 has a timer function.

In step S132, the CPU 13 determines whether the value of the absence confirmation period stored on the memory 12 exceeds a threshold for absence confirmation period stored on the memory 12. Note that the threshold for absence confirmation period stored on the memory 12 may be changed by inputting user settings by the input unit 18.

If the absence confirmation period exceeds the threshold (YES in step S132), the CPU 13 resets the value of the absence confirmation period stored on the memory 12 (step S133), and the input unit 18 waits for a control command relating to content transmission for a predetermined period (step S134), and then the CPU 13 determines whether the input unit 18 has inputted the control command (step S135). If the input unit 18 has inputted a control command (YES in step S135), the state transition 1, that is, the flow operation shown in FIG. 10, is executed (step S136), and the CPU 13 executes the control command (step S137), and then the absence/command confirmation ends. In contrast, if the input unit 18 has not inputted a control command (NO in step S135), the control command non-reception confirmation, that is, the flow operation shown in FIG. 14, is executed (step S138), and then the absence/command confirmation ends.

As a result of the determination in step S132, if the absence confirmation period does not exceed the threshold (NO in step S1132), the state transition 1, that is, the flow operation shown in FIG. 10, is executed (step S139), and the input unit 18 waits for a control command relating to content transmission for a predetermined period (step S140), and then the CPU 13 determines whether the input unit 18 has inputted a control command (step S141). If the input unit 18 has inputted a control command (YES in step S141), the CPU 13 executes the control command (step S142), and then the absence/command confirmation ends. In contrast, if the input unit 18 has not inputted a control command (NO in step S141), the control command non-reception confirmation, that is, the flow operation shown in FIG. 14, is executed (step S143), and then the absence/command confirmation ends.

Further, the transmitter 100 may have a low power consumption operating mode and a normal operating mode. In the low power consumption operating mode, the power consumption can be reduced by lowering the clock frequency of the CPU 2 comparing with the normal operating mode. Then, when the transmitter 100 is in the low power consumption operating mode and the human sensor 19 of the receiver 200 detects a human or the input unit 18 has inputted a control command relating to content transmission, an instruction for moving to the normal operating mode is transmitted from the receiver 200 to the transmitter 100. Thereby, low power consumption can be realized even in the transmitter 100.

In the embodiment described above, description has been given by using a content wireless transmission system as an example. However, communications between a transmitter and a receiver of a content transmission system according to another non-limiting embodiment may be wired communications. Further, although, in the above-described embodiment, a human sensor which detects humans by means of infrared ray is used, the present invention is not limited to this. There may be used a human sensor which detects humans by means of image recognition, a human sensor which detects humans by means of temperature, a human sensor which detects humans by means of voices, or a human sensor which detects humans by means of radio, for example. Note that as a human sensor which detects humans by means of radio, there is one which, in a case where a user puts on equipment transmitting an awake instruction with slight radio waves, detects the slight radio waves transmitted from the equipment, for example. Further, the transmitter 100 may incorporate content equipment or an antenna, and the receiver 200 may incorporate content viewing and listening equipment or an antenna. Further, content is not limited to data of video and audio, but may be data of video only or data of audio only.

What is claimed is:

1. A content transmission system having a transmitter and a receiver including a human sensor, the system comprising:

a content starting time change unit arranged to change a content starting time corresponding to a detection result of the human sensor, wherein the receiver includes an input unit arranged to input a control command relating to the content transmission, wherein when the control command is not inputted into the input unit for a predetermined time, a state of the receiver is changed, wherein states of the receiver include at least a first state in which the content transmission can start immediately, a second state in which a resource required for the content transmission is released, and a third state in which power consumption is smaller when compared with the first state and the second state, wherein when the control command is not inputted into the input unit for a first predetermined period when the receiver is in the first state, the state of the receiver changes to the second state or third state, and wherein when the control command is not inputted into the input unit for a second predetermined period when the receiver is in the second state, the state of the receiver changes to the third state.

2. The content transmission system of claim 1, wherein the content starting time change unit changes the state of the receiver corresponding to the detection result of the human sensor.

3. The content transmission system of claim 1, further comprising a stop unit arranged to stop the content transmission when the human sensor does not detect the human during the content transmission.

4. The content transmission system of claim 1, further comprising a stop unit arranged to stop the content transmission when the human sensor does not detect the human for a predetermined period during the content transmission.

5. The content transmission system of claim 1, further comprising a change unit arranged to change a sensor effective range of the human sensor.

6. The content transmission system of claim 1, further comprising a switch unit arranged to make the human sensor effective or ineffective.

7. The content transmission system of claim 2, wherein the content starting time change unit changes the state of the receiver corresponding to the detection result of the human sensor among the states including at least the first state in which the content transmission can start immediately, the second state in which a resource required for the content transmission is released, and the third state in which power consumption is smaller when compared with the first state and the second state.

8. The content transmission system of claim 4, further comprising a change unit for arranged to change the predetermined period.

9. The content transmission system of claim 7, wherein when the human sensor detects the human when the receiver is in the second state or in the third state, the state of the receiver changes to the first state.

10. The content transmission system of claim 7, wherein when the human sensor continuously detects the human for a predetermined period when the receiver is in the second state or in the third state, the state of the receiver changes to the first state.

11. The content transmission system of claim 7, wherein when the human sensor does not detect the human when the receiver is in the first state, the state of the receiver changes to the second state or the third state, and wherein when the human sensor does not detect the human when the receiver is in the second state, the state of the receiver changes to the third state.

12. The content transmission system of claim 7, wherein when the human sensor does not detect the human for a first predetermined period when the receiver is in the first state, the state of the receiver changes to the second state or the third state, and wherein when the human sensor does not detect the human for a second predetermined period when the receiver is in the second state, the state of the receiver changes to the third state.

13. The content transmission system of claim 10, further comprising a change unit arranged to change the predetermined period.

14. The content transmission system of claim 12, further comprising a change unit arranged to change the first and second predetermined periods.

* * * * *